US005467996A

United States Patent [19]

Greer

[11] Patent Number: 5,467,996

[45] Date of Patent: Nov. 21, 1995

[54] MULTIPLE BINGO GAME APPARATUS

[75] Inventor: Thomas W. Greer, Muskegon, Mich.

[73] Assignee: The Reliable Corporation of America, Muskegon, Mich.

[21] Appl. No.: 61,858

[22] Filed: May 12, 1993

Related U.S. Application Data

[60] Continuation of Ser. No. 938,856, Aug. 28, 1992, Pat. No. 5,338,042, which is a division of Ser. No. 788,039, Nov. 5, 1991, Pat. No. 5,160,146.

[51] Int. Cl.[6] ..... A63F 3/06

[52] U.S. Cl. ..... 273/269; 273/148 R

[58] Field of Search ..... 273/269, 148 R, 273/148 A, 270

[56] References Cited

U.S. PATENT DOCUMENTS

| | | | |
|---|---|---|---|
| Des 258,156 | 2/1981 | Jeffries . | |
| 3,811,680 | 5/1974 | Benesch . | |
| 4,019,744 | 4/1977 | Pizur, Sr. . | |
| 4,084,823 | 4/1978 | Häggedal . | |
| 4,448,127 | 5/1984 | Frain | 273/169 |
| 4,775,155 | 10/1988 | Lees . | |
| 4,838,557 | 6/1989 | Floyhar . | |
| 4,848,771 | 7/1989 | Richardson . | |
| 4,883,636 | 11/1989 | Fantle, Jr. . | |

OTHER PUBLICATIONS

Arrow International "9–on" Bingo Sheet, 1989.
St. Bartholomew Bingo Hard Card, date unknown.
A. J. Widdman Co.–Price Sheet and brochure, 1979.
Bingo King Catalog excerpt, 1987.

*Primary Examiner*—Vincent Millin
*Assistant Examiner*—William M. Pierce
*Attorney, Agent, or Firm*—Varnum, Riddering Schmidt & Howlett

[57] ABSTRACT

An improved bingo game sheet and method for playing the same are disclosed. The game sheet comprises at least three bingo matrix designated by a first indicia, at least two second bingo matrix designated by a second indicia and at least one third bingo game matrix, but less than the number of second bingo game matrices, the third bingo game matrices being identified by a third common indicia. When the desired configuration is created on the first indicia a player wins a first prize which is distinct from a second prize and third prize awarded when a player obtains the desired configuration on a second and third bingo game matrices, respectively. Preferably, a plurality of game sheets are arranged sequentially in a packet such that the used game sheet may be easily discarded.

20 Claims, 3 Drawing Sheets

MULTIPLE BINGO GAME APPARATUS

RELATED APPLICATION INFORMATION

This is a continuation application of U.S. patent application Ser. No. 07/938,856 filed Aug. 28, 1992, now U.S. Pat. No. 5,338,042, which is a divisional application of U.S. patent application Ser. No. 07/788,039, filed Nov. 5, 1991, now U.S. Pat. No. 5,160,146 issued Nov. 3, 1992.

BACKGROUND OF THE INVENTION

1. Field of the Invention

This invention relates to an improved bingo game, and more particularly, to a multiple bingo game card or sheet.

2. Description of Related Art

The game of chance known as bingo has been played for years in churches, schools and bingo halls and is often a major source of revenue for the sponsor of the game. To provide more variety for the game and to attract and retain players, bingo halls have created numerous variations of the standard bingo game.

The traditional bingo game is a game of chance in which players are given one or more cards with a matrix of five vertical columns and five horizontal rows. One letter of the word BINGO is located at the top of each vertical column with a 5×5 matrix of numbers below the letters. Five numbers, randomly selected between 1 and 15 are located beneath the letter B; five randomly selected numbers between 16 and 30 are located beneath the letter I; five randomly selected numbers between 31 and 45 are located beneath the letter N; five randomly selected numbers between 46 and 60 are located beneath the letter G; and five randomly selected numbers between 61 and 75 are located beneath the letter O. A bingo caller randomly selects balls numbered 1 through 75, calling out the selected numbers. Once a player has numbers on his or her game card which have been called and which create a predetermined configuration, this player yells "Bingo" and wins the game. It is not uncommon for more than one player to create the predetermined configuration at the same time, these players must share the prize.

In what is known as "straight-line" bingo, the winner is the first player to get a straight-line either horizontally, vertically or diagonally across the bingo matrix.

Bingo halls typically play a series of straight-line bingo games over the course of an evening. To make the games more exciting, the bingo hall can modify the straight-line bingo game by providing for a higher bonus cash prize if the winning combination is on one or more specially designated bonus bingo matrices. Typically, the player has to purchase the bonus bingo matrices separately from the straight-line bingo matrices which have the lower cash prize. These different matrices are typically distinguished by the color the bingo card.

The bingo hall may also periodically play "specials" which differ from the straight-line bingo game in the configuration of the winning combination of numbers. Specials also have a significantly larger cash prize than straight-line bingo In an example of a "special" players must create a "picture frame" on the bingo matrix in order to win. A picture frame is created when the player has filled all of the spaces around the perimeter of his or her card. Another example of a special is an "X" game. In this variation, the player wins when the marks on his or her card extend diagonally from corner to corner of the matrix thereby creating an X shape. Numerous other "specials" are possible. Specials are not played on hard cards, they are played on specially printed disposable paper sheets.

Traditionally, a bingo hall purchases a stock of bingo matrices which are printed on thick durable paper or cardboard. These cards are known as "hard cards" with one matrix on each card. The bingo games would begin each evening with the players arriving early enough to sift through the hall's stock of cards to locate suitable cards or cards which were "lucky". Typically, each player plays several straight-line cards and one or more bonus cards for each straight-line game. The player must pay for each card which he or she intends to play during the evening.

The bingo game proceeds by the caller randomly selecting one of the 75 bingo balls and calling out the appropriate number. The balls are typically drawn rapidly with a prescribed period of time in between each ball that is drawn. When playing a hard card, the player marks his bingo matrix by placing a plastic chip or marker of some kind over the number after it has been called. At the conclusion of each individual game, the hard card player has to clear the chips from his or her card and prepare for the next game. Most players use chips with a ferro-magnetic material embedded therein and a magnetic wand to gather up the chips from their several cards at the end of the game.

At the end of the evening, the hall collects the cards and reuses them. Hard cards are used repeatedly which is unsanitary and often results in players using faded, bent or soiled cards. It is not uncommon for players to purposely fail to return cards which they consider to be lucky at the end of the evening. Another problem in using hard cards is the time required each evening for the players to sift through the cards to locate acceptable cards. In addition, the hall must replace the cards periodically when the cards become mutilated after repeated use or when they are stolen.

As an alternative to "hard cards" for bingo, some halls play on "paper" cards. Paper cards are sold in packages which comprise multiple sheets of paper stacked upon each other. Each sheet of paper has multiple bingo matrices printed thereon. When the player arrives to the bingo hall, instead of choosing individual hard cards, he or she purchases one or more paper packets. Each packet contains one sheet for each game of the evening. The player plays all of the bingo matrices on the first sheet for the first game and marks these sheets with an ink marker bottle or ink "dauber" as the numbers are called. Once a winner is declared and the game is over, the player merely removes the top sheet from the paper packet and plays the next game on the next adjacent sheet. The marked sheet is discarded.

There are several advantages to paper over hard cards. First, players need not sift through a stack of cards which are soiled and unsanitary. Secondly, the players can use an ink marker or dauber to quickly mark the bingo matrices as the game proceeds. The use of ink daubers is much quicker than the removable chips used with hard cards. Ink daubers eliminate the need to gather up the chips from the several different cards at the termination of the game.

Not surprisingly, there are devoted hard card players who refuse to play paper and likewise there are paper players who refuse to go back to hard cards. This dilemma has presented problems for bingo halls in attempting to accommodate both hard card players and paper players. Most halls play only hard cards or only paper. These halls are undoubtedly losing potential players because of the players' particular preference. One alternative is to operate a hall in which players have the option of playing hard cards or playing paper, a "hybrid game".

The problem with a hybrid hard card/paper game is the ability of the paper player to participate in the bonus colored hard cards. The paper player not only has to purchase his paper packet, but also must purchase the individual bonus colored hard cards. It is extremely difficult, if not impossible for a paper player to play both the paper and hard cards at the same time. The paper player must use his or her ink marker bottle for the paper card and also use chips to play the bonus colored hard cards. The bingo hall will not permit the player to use the ink marker on the hard cards because the ink would destroy the card. At the speed at which numbers are called during the game, it is extremely difficult for the paper player to keep up with both the paper and the bonus hard cards at the same time because he or she has to mark the matrices differently.

A hybrid game also requires a hard card player to come equipped with chips and a wand for use on the hard cards and an ink dauber and a sheet of plastic for the paper specials. Usually the hard card player lays his or her cards out in front of them during the traditional straight-line bingo games. When a special game is played, hard card players usually place the paper special on top of their hard cards. To prevent ink from passing through to the hard cards below, hard card players are forced to bring a small sheet of plastic to prevent the ink from passing through.

Therefore, it can be seen that the hard card player has to bring extra .equipment to the hall in order to participate in both the specials and the hard card and bonus games. Similarly, the paper player is faced with the dilemma of trying to play both hard cards and paper in order to participate in the straight-line game and the bonus games. Therefore, hybrid games are an inconvenience for both the hard card and the paper player.

SUMMARY OF INVENTION

According to the invention, an improved bingo game comprises a sheet of paper having at least one first bingo game matrix printed on the paper sheet designated by a first indicia and at least one second bingo matrix, distinct from the first matrix printed on the same side of the paper sheet and designated by a second indicia different from the first indicia. A player can play at least two separate types of bingo games on the same sheet of paper. Preferably, at least one third bingo game matrix is printed on the paper sheet and is designated by a third indicia. Thus, a player can play at least three types of bingo games at the same time on the same sheet of paper.

In a preferred embodiment of the invention, the second and third indicia are colors. The first indicia is preferably black and white printing.

In a preferred embodiment of the invention, there are three third bingo game matrices on the sheet of paper, there are nine first bingo games matrices printed on the sheet and there are six second bingo game matrices printed on the sheet.

In yet another embodiment, a plurality of the game sheets are stacked in a packet in a predetermined order and each of the game sheets has matrices different from the matrices of the other sheets. The sheets are preferably retained in a packet by a strip of adhesive along one edge of the sheets.

Further according to the invention, there is provided a method for playing a game of bingo comprising steps of providing a bingo game sheet with at least one first bingo game matrix designated by a first indicia, providing the bingo game sheet with at least one second bingo matrix designated by a second indicia, distributing at least one of the bingo game sheets to each of a number of players, serially selecting bingo numbers. The players mark the game sheet as the bingo numbers are selected. One or more winners are declared when one or more players have marked a predetermined configuration on a bingo game matrix on the game sheet according to the selected bingo numbers. The game sheets are then discarded after the game and new sheets are then used for the next game. Winning players receive a first prize when a predetermined configuration is created on one of at least one first bingo game matrix or a second prize when the predetermined configuration is created on one of the second bingo game matrix. A plurality of game sheets can be distributed to each player. The invention further contemplates the step of arranging the plurality of game sheets in a desired sequence in order to facilitate an orderly progression from one bingo game to the next.

In a preferred embodiment, the bingo game sheets have at least one third bingo matrix designated by a third indicia wherein the winning players receive a third prize when the predetermined configuration is created on one of the at least one third bingo game matrix.

Typically, the players mark the game sheet with an ink marker as the bingo game numbers are serially called. Further, the winning player yells "bingo" as the predetermined configuration is created from the numbers called.

BRIEF DESCRIPTION OF THE DRAWINGS

The invention will now be described with reference to the drawings wherein.

DESCRIPTION OF THE PREFERRED EMBODIMENT

Figure 1:
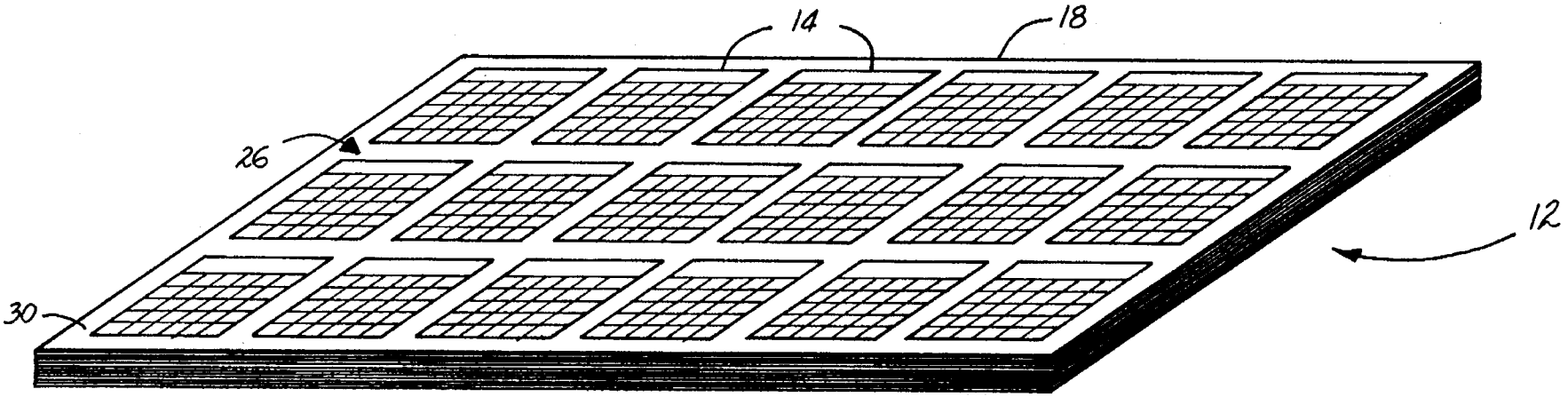
FIG. 1 is a perspective view of a packet of paper bingo sheets according to the invention.
Figure 2:
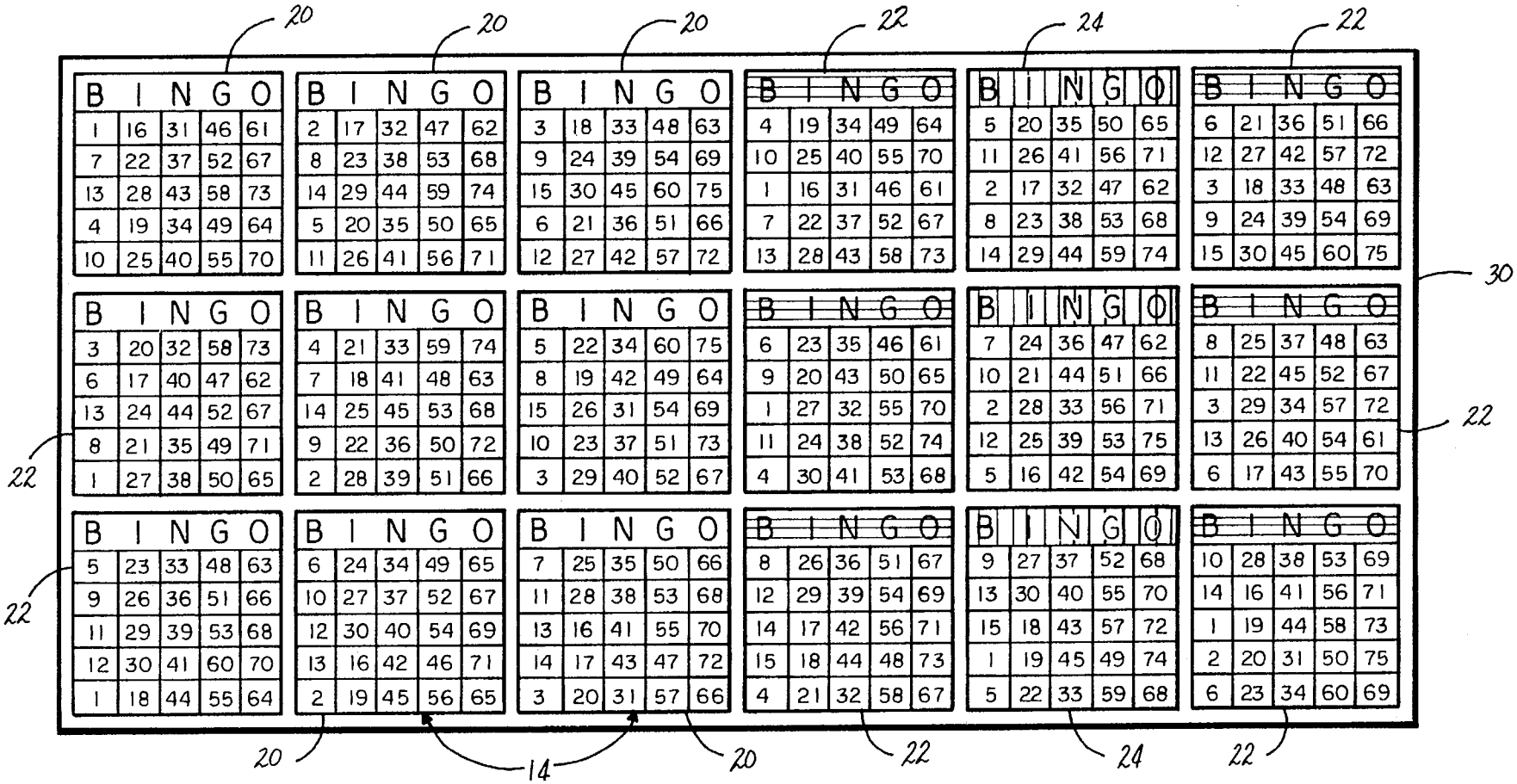
FIG. 2 is a plan view of a typical straight-line bingo paper sheet of matrices according to the invention.
Figure 3:
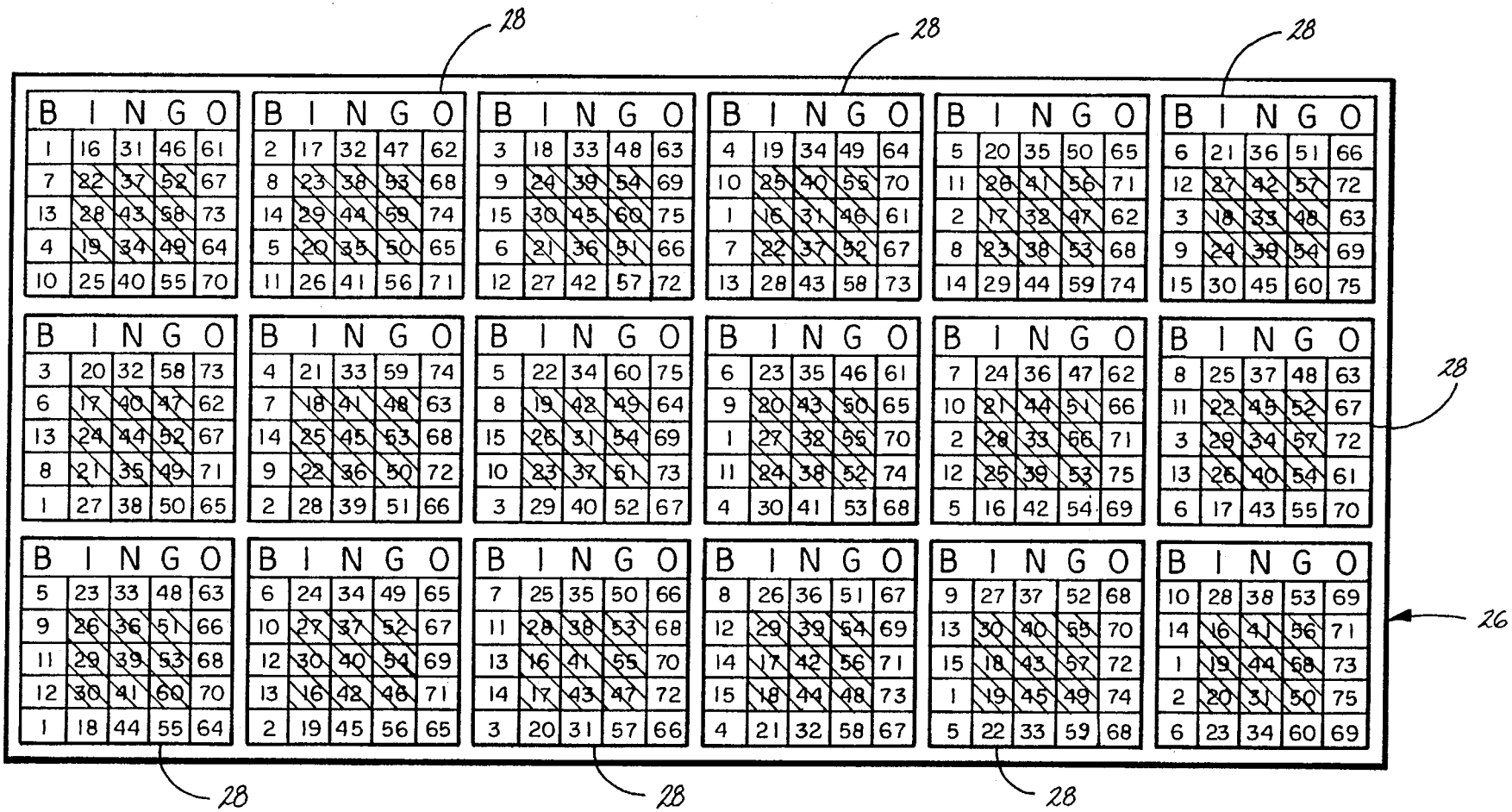
FIG. 3 is a plan view of a "special" bingo playing sheet according to the invention.

Referring now to the drawings and to FIG. 1 in particular, a paper packet 12 containing a plurality of bingo matrices 14 printed on an individual sheet of paper 16 is shown. The packet 12 comprises a plurality of sheets which are arranged in a designated order. A line of adhesive 18 or other means may be utilized along one edge of the packet 12 to create a unitary packet 12 of the individual sheets 16. Preferably, the sheets 16 within the packet 12 would be arranged according to the sequence of games to be played throughout the course of the session. For example, the top four sheets 16 of the packet 12 can be particularly suited for straight-line bingo games. The fifth sheet 16 within the packet could be specially printed and configured for a "special" such as a picture frame game or an "X" game. This special sheet 26 (FIG. 3) can be followed by four sheets 16 of straight-line bingo which is, in turn, followed by another special game sheet 26 (FIG. 3). In the preferred embodiment, there are sixteen straight-line bingo game sheets 30 (FIG. 2) and four special game sheets 26 (FIG. 3) wherein a special sheet is inserted after each series of four straight-line game sheets 30 (FIG. 2). Each individual bingo hall or organizer of the game may establish any sequence for the games and organize the sheets accordingly.

As seen in FIGS. 1 and 2, the straight-line bingo sheet 30 comprises a plurality of bingo matrices 14 printed on a sheet of paper 16. In the preferred embodiment, the sheet 16 has six columns and three rows of bingo matrices 14 printed thereon for a total of eighteen matrices. A set of standard or first bingo matrices 20 are printed on the straight-line sheet 30 and designated by a first indicia. In the first embodiment, the first bingo matrices 20 are printed only in black and white. Preferably, the sheet 16 has three columns and three rows of the first bingo matrices 20 for a total of nine standard or first bingo matrices 20.

The straight-line sheet 30 also comprises a second set of bingo matrices 22, distinct from the first, which are designated by a second indicia, such as printing in a particular color distinct from the black and white printing of the first bingo matrices 20. In the preferred embodiment, there are two columns and three rows of the second colored matrices 22 for a total of six matrices colored blue. The straight-line sheet 30 of the preferred embodiment also has a single column of third colored matrices 24 which are designated by the color red. It is to be understood that the particular number of matrices or the indicia can be varied pursuant to the desires of the bingo game organizer.

As seen in FIG. 3, a "special" bingo game series of matrices 28 is shown mounted on a special game sheet 26. The special game sheet 26 preferably has six columns and three rows of bingo matrices 14 printed thereon for a total of eighteen special bingo matrices 28. The special game depicted in FIG. 3 is a "picture frame" game. As seen in FIG. 3, each of the special bingo matrices 28 have the winning configuration depicted thereon by a suitable color shading.

In a picture frame variation of the traditional bingo game, the player wins when the numbers called create a square which extends around the outer perimeter of the special bingo matrix 28. In the preferred embodiment, the interior of the picture frame is shaded green. In order to win, the winning player must mark all of the spaces not shaded. It is to be understood that the special bingo matrices 28 depicted in FIG. 3 are merely an example of one of numerous specials suitable for use according to the invention. Any special bingo matrix game played on a bingo matrix 14 can be substituted therefor.

The paper packet 12 according to the invention is easily used in a bingo hall which plays paper only or a hybrid game. As each paper player arrives, he or she purchases one or more paper packets 12. The hard card player must purchase acceptable regular straight-line hard cards and straight-line bonus hard cards. The paper player has the bonus and regular straight-line matrices already printed thereon.

Play begins with all paper players playing on the bingo matrices 14 printed only on the top sheet 16 of the paper packet 12 and the hard card players playing all of their hard cards. As the bingo numbers are called, the paper players can easily and quickly mark both the regular and bonus matrices on the paper packet 12 with an ink bottle marker. The hard card player still uses his or her chips. The game terminates when one or more players get a bingo. When the first game is completed, the paper players simply remove the top sheet 16, discard it and prepare to play the second sheet of the stacked paper packet 12. The hard card players must remove their chips from the several hard cards.

The added benefit of the paper packet 12 according to the invention is the inclusion of the second colored matrices 22 and third matrices 24 which are used for bonus cash prize games. If the numbers called create a winning combination on one or more of the second or third colored matrices, 22 and 24, then the player would receive a bonus cash prize. By including the colored matrices on the paper sheet 16, the paper player can easily use an ink marker for playing both the regular straight-line game and the bonus games. There is no need for the player to use chips or plastic bingo markers in addition to the ink marker. More importantly, it gives the paper player the opportunity to participant in the straight-line enhanced bonus games previously played exclusively on colored hard cards.

Another added benefit of incorporating the bonus matrices 22 and 24 on the paper sheets 16 is to simplify hybrid games. Paper players can now mark both the straight-line regular hard cards and bonus matrices at least as quick as the hard card players. Therefore, hard card players and paper players are more equally matched in a hybrid game, thereby eliminating much of the tensions between the paper players and hard card players.

While particular embodiments of the invention have been shown, it will be understood that the invention is not limited thereto since modifications may be made by those skilled in the art, particular in light of the foregoing teachings. Reasonable variation and modification are possible within the foregoing disclosure and drawings without departing from the scope of the invention.

The embodiments of the invention in which an exclusive property or privilege is claimed are defined as follows:

1. An improved bingo game apparatus comprising;

a sheet of paper;

at least three first bingo game matrices printed on the sheet of paper, the first bingo game matrices being identified by a first common indicia;

at least two second bingo game matrices, but less than the number of first bingo game matrices, printed on the sheet of paper, the second bingo game matrices being identified by a second common indicia; and at least one third bingo game matrices, but less than the number of second bingo game matrices, printed on the sheet of paper, the third bingo game matrices being identified by a third common indicia;

wherein, one prize is awarded for a winning combination on a first bingo game matrix, another prize is awarded for a winning combination on a second bingo game matrix, and still another prize is awarded for a winning combination on a third bingo game matrix.

2. An improved bingo game apparatus according to claim 1 further comprising three third bingo game matrices.

3. An improved bingo game apparatus according to claim 2 further comprising six second bingo game matrices.

4. An improved bingo game apparatus according to claim 3 further comprising nine first bingo game matrices.

5. An improved bingo game apparatus according to claim 1 further comprising a plurality of said sheets of paper arranged in a packet in a predetermined order.

6. An improved bingo game apparatus according to claim 5 wherein said plurality of sheets are retained in said packet by a strip of adhesive along one edge of the plurality of sheets.

7. An improved bingo game apparatus according to claim 1 further comprising nine first bingo game matrices.

8. An improved bingo game apparatus according to claim 7 further comprising six second bingo game matrices.

9. An improved bingo game apparatus according to claim 8 further comprising three third bingo game matrices.

10. An improved bingo game apparatus comprising;

a plurality of sheets of paper bound together in a packet, at least one of said sheets of paper having;

at least three first bingo game matrices printed thereon, the first bingo game matrices being identified by a first common color indicia;

at least two second bingo game matrices, but less than the number of first bingo game matrices, printed thereon, the second bingo game matrices being identified by a second common color indicia; and at least one third bingo game matrix, but less than the number of second bingo game matrices, printed on the sheet of paper, the third bingo game matrix being identified by a third common color indicia;

wherein, one prize is awarded for a winning combination on a first bingo game matrix, another prize is awarded for a winning combination on a second bingo game matrix, and still another prize is awarded for a winning combination on a third bingo game matrix.

11. An improved bingo game apparatus according to claim 10 further comprising three third bingo game matrices.

12. An improved bingo game apparatus according to claim 11 further comprising six second bingo game matrices.

13. An improved bingo game apparatus according to claim 12 further comprising nine first bingo game matrices.

14. An improved bingo game apparatus according to claim 10 wherein said plurality of sheets are retained in said packet by a strip of adhesive along one edge of the plurality of sheets.

15. An improved bingo game apparatus comprising;

a sheet of paper;

at least three first bingo game matrices printed on the sheet of paper, the first bingo game matrices being identified by a first common indicia;

at least one second bingo game matrix, but less than the number of first bingo game matrices, printed on the sheet of paper, the second bingo game matrices being identified by a second common indicia; and at least one third bingo game matrices, but less than the number of second bingo game matrices, printed on the sheet of paper, the third bingo game matrices being identified by a third common indicia;

wherein, a first prize is awarded for a winning combination on a first bingo game matrix, a second prize is awarded for a winning combination on a second bingo game matrix, and a third prize is awarded for a winning combination on a third bingo game matrix.

16. An improved bingo game apparatus according to claim 15 further comprising nine first bingo game matrices.

17. An improved bingo game apparatus according to claim 16 further comprising six second bingo game matrices.

18. An improved bingo game apparatus according to claim 17 further comprising three third bingo game matrices.

19. An improved bingo game apparatus according to claim 15 further comprising a plurality of said sheets of paper arranged in a packet in a predetermined order.

20. An improved bingo game apparatus according to claim 19 wherein said plurality of sheets are retained in said packet by a strip of adhesive along one edge of the plurality of sheets.

* * * * *